US010947970B2

(12) United States Patent
Trossmann et al.

(10) Patent No.: US 10,947,970 B2
(45) Date of Patent: Mar. 16, 2021

(54) MODULAR SYSTEM FOR PRODUCING A SCREW SPINDLE PUMP

(71) Applicant: LEISTRITZ PUMPEN GMBH, Nuremberg (DE)

(72) Inventors: Oliver Trossmann, Oberasbach (DE); Ralf Richter, Fürth (DE)

(73) Assignee: LEISTRITZ PUMPEN GMBH, Nürnberg (DE)

( * ) Notice: Subject to any disclaimer, the term of this patent is extended or adjusted under 35 U.S.C. 154(b) by 283 days.

(21) Appl. No.: 15/997,969

(22) Filed: Jun. 5, 2018

(65) Prior Publication Data

US 2018/0355864 A1 Dec. 13, 2018

(30) Foreign Application Priority Data

Jun. 9, 2017 (DE) ..... 10 2017 112 743.7

(51) Int. Cl.
*F04C 2/16* (2006.01)
*F04C 11/00* (2006.01)

(52) U.S. Cl.
CPC ..... *F04C 2/16* (2013.01); *F04C 11/001* (2013.01); *F04C 2240/20* (2013.01); *F04C 2240/30* (2013.01); *F04C 2240/70* (2013.01)

(58) Field of Classification Search
CPC ..... F04C 2/16; F04C 2240/70; F04C 11/001
See application file for complete search history.

(56) References Cited

U.S. PATENT DOCUMENTS 6,413,065 B1 7/2002 Dass
7,862,315 B2 1/2011 Rohlfing
(Continued)

FOREIGN PATENT DOCUMENTS

CA 2282231 A1 9/2000
CN 103075336 A 5/2013
(Continued)

OTHER PUBLICATIONS

Chinese Patent Office issued an Office Action dated Dec. 27, 2019 regarding parallel Chinese Patent Application No. 201810570176.9 including English translation thereof, 4 pages.
(Continued)

*Primary Examiner* — Mary Davis
(74) *Attorney, Agent, or Firm* — Lucas & Mercanti, LLP; Klaus P. Stoffel

(57) ABSTRACT

A modular system for producing a screw spindle pump having a housing with a drive spindle therein and at least one running spindle meshing with the drive spindle, including:

a plurality of housing components including a basic housing component exhibiting a fluid inlet for the formation of a basic pump chamber, a housing pressure component exhibiting a fluid outlet, bearing the drive spindle for creating a pressure chamber, a housing cover arranged on the basic housing part for supporting running spindle, and identical intermediate housing components arrangeable in any number between the basic housing component and the housing pressure component and form an additional pump chamber in each case; and a plurality of running spindle elements including at least one running spindle base element arranged in the basic housing component, and identical running spindle extension elements arranged in the intermediate housing components.

10 Claims, 6 Drawing Sheets

(56) References Cited

U.S. PATENT DOCUMENTS

| | | | | |
|---|---|---|---|---|
| 2007/0248480 | A1* | 10/2007 | Mayer | F04C 11/001 418/206.1 |
| 2014/0099225 | A1 | 4/2014 | Denny | |
| 2019/0338769 | A1* | 11/2019 | Tsuzuki | F04C 2/16 |

FOREIGN PATENT DOCUMENTS

| | | | | |
|---|---|---|---|---|
| DE | 102005025816 | A1 | 12/2006 | |
| DE | 202016102499 | U1 | 7/2016 | |
| EP | 0843094 | A1 * | 5/1998 | F04C 2/16 |
| EP | 2765311 | A2 | 6/2014 | |

OTHER PUBLICATIONS

Intellectual Property India issued an Examination Report dated Dec. 19, 2019 regarding parallel Indian Patent Application No. 201824020869, 7 pages.

* cited by examiner

MODULAR SYSTEM FOR PRODUCING A SCREW SPINDLE PUMP

CROSS-REFERENCE TO RELATED APPLICATIONS

The present application claims priority of DE 10 2017 112 743.7, filed Jun. 9, 2017, the priority of this application is hereby claimed and this application is incorporated herein by reference.

BACKGROUND OF THE INVENTION

The invention relates to a modular system for producing a screw spindle pump.

Screw spindle pumps of this kind are used for example for conveying oils or other more or less heavily lubricating fluids. A screw spindle pump of this kind comprises a housing and also a drive spindle received therein which meshes with one or two running spindles received on the housing side. The thread flanks which engage with one another enable the spindles to form sealed chambers. If the drive spindle is turned, the running spindles also rotate automatically. This means that the fluid that is drawn up and held in the chambers is continuously conveyed axially from the suction side to the discharge side of the pump where it is delivered via the outlet.

Screw spindle pumps of this kind are known in different embodiments for specific pressure stages, for example low pressure, medium pressure, high pressure, ultra-high pressure, etc. The corresponding components are separately produced for each pressure stage and configured in the construction length required in each case. This means that for each pressure stage a pump body that has a corresponding length and also correspondingly dimensioned drive and running spindles are produced. Both the pump body and also the spindles are of one-piece design. The construction length required in each case and therefore the design of the screw spindle pump varies depending on the requirement in terms of the desired pressure difference, the viscosity of the fluid to be conveyed, etc. Particularly in the case of larger or longer pumps, the machining of the corresponding components is made more difficult by the increasing component length and therefore the machining length, which makes screw spindle pumps of this kind expensive to produce.

SUMMARY OF THE INVENTION

The problem addressed by the invention is therefore that of specifying an improved screw spindle design compared with this one.

To solve this problem, a modular system is provided according to the invention for producing a screw spindle pump comprising a housing and also a drive spindle received therein and one, two or multiple running spindles meshing with said drive spindle, comprising:

a plurality of housing components comprising a basic housing component exhibiting a fluid inlet for the formation of a basic pump chamber, a housing pressure component exhibiting a fluid outlet, bearing the drive spindle for creating a pressure chamber, a housing cover that can be arranged on the basic housing part for supporting one, both or all running spindles, and identical intermediate housing components which can be arranged in any number between the basic housing component and the housing pressure component and form an additional pump chamber in each case, a plurality of running spindle elements comprising one, two or multiple running spindle base elements that can be arranged in the basic housing component, and also identical running spindle extension elements that can be arranged in the intermediate housing components.

The modular system according to the invention for configuration of a screw spindle pump allows a screw spindle pump with selectable pump length to be produced simply from standardized components that can be identically produced for all producible pump sizes. The only non-modular pump component is the drive spindle which has to be produced as a one-piece component corresponding to the desired pump size.

The modular system comprises a basic housing component. This exhibits the fluid inlet, in other words the suction side, and forms a basic pump chamber which at the same time forms the smallest pump chamber of the smallest producible pump size.

The system further comprises a housing pressure component which creates the pressure chamber and has a fluid outlet, in order to deliver the fluid that has been drawn up and conveyed at the corresponding pump pressure from the pump again. The drive spindle is received in this housing pressure component in a mounted and sealed manner.

Furthermore, the system comprises a housing cover that can be arranged on the basic housing component, which housing cover closes off the housing component on this side (it is closed off on the opposite side by the housing pressure component). The running spindle or running spindles is/are normally supported hydrostatically on the housing cover for axial thrust alignment.

The basic housing component, the housing pressure component, and also the housing cover are the three components which, as far as the configuration of the housing is concerned, are installed in each producible pump size.

For the further variation of the pump size or else the pump length, the system comprises a plurality of identical intermediate housing components, any number of which can be installed between the basic housing component and the housing pressure component. These intermediate housing components therefore extend the basic pump chamber by the corresponding length of one or more additional pump chambers, depending on how many of these identical intermediate housing components are placed between the basic housing component and the housing pressure component. Each intermediate housing component, as well as the basic housing part, of course also exhibits corresponding holes for receiving the continuous drive spindle and also the running spindles.

These intermediate housing components enable the pump housing to be produced in different lengths. The smallest pump size, as stated, is defined in terms of its working length via the basic housing component and also the housing pressure component fastened thereto. The next larger pump size therefore has an intermediate housing component placed between the basic housing component and the housing pressure component, so that the pump chamber is formed from the basic pump chamber and an extending additional pump chamber. The next pump size in turn is characterized by two intermediate housing components placed in between, so that the pump chamber is defined via the basic pump chamber and also two additional pump chambers extending said basic pump chamber. In this way, through continuing integration of further intermediate housing components, the length of the pump housing can be constantly increased up to a maximum pump length which is ultimately defined via the maximum producible length of the drive spindle which is produced in one piece, as described.

Just as the housing has a modular design made up of standardized components and can be extended to any length, the one or both running spindles is/are also of modular design made up of standardized running spindle elements. The system comprises a plurality of running spindle elements and, among these, one or two running spindle base elements that can be arranged in the basic housing component. This or these running spindle elements are the spindle elements that can be used in any pump size. They have length dimensions corresponding to the spindle bore length of the basic housing component and are arranged in the installed state in the basic housing component, in other words the basic pump chamber. In the case of the smallest pump size, the/each running spindle is therefore formed by only one running spindle base element.

As the pump length increases and with the pump housing extended by the insertion of intermediate housing components, the respective running spindle also has to be lengthened. This happens via a plurality of identical running spindle extension elements which are arranged in each case in the intermediate housing component(s), depending on how many are arranged between the basic housing component and the housing pressure component. The number of intermediate housing components corresponds to the number of running spindle extension elements per running spindle. In this way, the running spindle can therefore also be modularly configured in any length corresponding to the length of the pump housing.

The modular system according to the invention is therefore made up of a series of standardized components, namely the standardized housing components and also the standardized running spindle elements. Each producible pump always has a basic housing component, a housing cover, a housing pressure component and also a running spindle base element and also, of course, the corresponding one-piece drive spindle produced to suit the pump types. The possibility of extending the pump is facilitated via the standardized intermediate housing components which are identical to one another and also the standardized running spindle extension elements which are likewise identical to one another. This allows screw spindle pumps of different lengths and different output to be produced, wherein only the drive spindle has to be produced in a size-specific manner in the corresponding length.

Apart from the simple design and also the possibility of varying sizes, this modular system also offers further advantages in terms of the production of corresponding components or identical parts, for example. This is because substantially shorter components or spindle elements can be produced in each case, compared with the one-piece parts known in the art hitherto, which means that parts production is simplified. At the same time, the production quality of the pump that has been produced remains high, irrespective of the component length, as only short, standardized parts have to be produced. The configuration of very long pumps, e.g. for very high pressures, is also possible irrespective of production, and the storage and parts management is also substantially simplified, as only short, standardized parts, a greater number of which can also be produced for stock, have to be kept.

According to an advantageous development of the invention, it is provided that the division of the housing components and the running spindle elements is identical. This means that the dividing planes of the housing components and the dividing planes of the running spindle elements coincide. This applies irrespective of whether the pump is made up of the basic housing component, the housing pressure component and only one intermediate housing component placed in between or whether a plurality of intermediate housing components of this kind and, inevitably, then also a plurality of running spindle extension elements are installed. This divisional uniformity has advantages in respect of the hydrostatic sliding bearing of the running spindle elements in the housing components. The running spindle elements are mounted on plain bearings on the hole wall of the respective housing component hydrostatically with a small space of only a few micrometers, in other words across a lubricating film. Since a transition from one housing component to the next housing component cannot be produced without any kind of step, it is advantageous for the dividing plane of the running spindle elements to lie within this very dividing plane region too. It can then be ensured via corresponding measures on the part of the running spindle element configuration that there is no direct abutment of the running spindle elements on the housing wall in this region, but there is always a hydrodynamic plain bearing mounting.

This may, in particular, be ensured in that, as can be further provided according to the invention, the running spindle extension elements and the running spindle base elements only abut one another with their planar end faces. In other words, the spindle elements cannot be fixedly connected to one another, but only abut one another axially, in other words are infinitesimally radially movable relative to one another. A connection is not required, since the running spindle elements with their thread flanks are engaged with the thread of the drive spindle and they are thereby carried along. If the length of a running spindle extension element or a running spindle base element exactly corresponds to the respective length of the corresponding intermediate housing component or the basic housing component, the concrete spindle element position can be precisely adjusted in relation to the respective hole wall of the respective housing component, since if required a minimum adjustment in the micrometer range is possible where necessary.

For assembly of the intermediate housing components, it may be provided that the intermediate housing components have axial through-holes in an arrangement distributed about the periphery with a screw head recess on the end face and axial threaded holes, wherein the through-holes and the threaded holes are provided in an alternating arrangement to one another. This hole profile allows the intermediate housing components, which must be arranged in a correspondingly rotated position relative to one another, to be connected to one another and also to the basic housing component and the housing pressure component. Through the through-holes with the screw head recess on the end face, the corresponding connection screws are passed through the one intermediate housing component and screwed into the axial threaded holes on the end face of the adjacent intermediate housing element. In this way, any number of intermediate housing elements can be integrated and connected to one another. The configuration of the threaded holes furthermore means that corresponding connection screws which are guided through the housing pressure component can also be screwed in the adjacent intermediate housing component. Likewise, connection screws of the intermediate housing element adjacent to the basic housing component guided through the corresponding through-holes can be screwed into corresponding threaded holes in the basic housing component.

The housing pressure component itself may preferably comprise two housing pressure component elements connected or connectable to one another axially via screw connections. As stated, the pressure chamber plus fluid outlet is provided in the housing pressure component, on the one hand, but on the other hand the bearing and sealing of the drive spindle is also realized. The formation of these different functional portions, even though the housing pressure component has a modular design to this extent and is made up of these two standardized housing pressure component elements which are identical for all sizes, is more easily possible.

Furthermore, on the housing pressure component for connection to the basic housing component in the case of the smallest pump size or to an adjacent intermediate housing element, only through-holes are provided which are configured where necessary with screw head recesses on the end face. This is possible in the case of a one-piece embodiment of the housing pressure component.

However, if the housing pressure component is likewise of modular design comprising two housing pressure component elements, a corresponding hole configuration is provided in this case too with through-holes and threaded holes in the corresponding housing pressure component elements. Hence in this case, through-holes are preferably configured on the axially outer housing pressure component element, which through-holes are formed where necessary with screw head recesses on the end face and axial through-holes on the axially internal housing pressure component element in an arrangement distributed about the periphery, said through-holes having a screw head recess on the end face, and also axial threaded holes, wherein the through-holes and the threaded holes are provided in an alternating arrangement in one another. This embodiment firstly allows the housing pressure component element at the axial end to be connected to the adjacent second housing pressure component element. The connection screws are passed through by the through-holes provided in the outer housing pressure component element and screwed into the threaded hole of the adjacent housing pressure component element. In order to connect this either to the housing base component or the adjacent intermediate housing element, alongside the threaded holes on the end face additional axial through holes with a screw head recess on the end face are provided on the internal second housing pressure component element. The connection screws are guided through these through-holes for connection to the basic housing component or the adjacent intermediate housing element, which connection screws are screwed into the threaded holes there. A distributed, alternating arrangement of threaded holes and through-holes is advantageous in this case too.

The basic housing component is, for its part, provided only with threaded holes at the two axial end faces. These allow, on the one hand, the fastening of the housing cover which exhibits corresponding through-holes through which corresponding connection screws are passed which are screwed into the threaded holes of the basic housing component. From the other side, the connection screws which pass through either the housing pressure component or the internal housing pressure component element or pass through the adjacent intermediate housing element are screwed in.

The length of the running spindle base elements is advantageously greater than the length of the running spindle extension elements. The basic housing component forms the basic pump chamber; it should have corresponding length dimensions, since the fluid inlet is also provided on it. By contrast, the intermediate housing elements and the additional pump chambers formed by them have slightly shorter dimensions.

Furthermore, it may be provided that the ends of the running spindle base elements arranged adjacent to the housing cover are received in the alignment sleeves used to align the axial thrust. In the running spindle base element, a customarily hydrostatic axial thrust alignment takes place, for which purpose the corresponding alignment sleeves are provided which are fitted on the ends of the running spindle base elements and extend with their sleeve end faces adjacent to the housing cover.

Apart from the modular system itself, the invention further relates to a pump produced using a modular system of the kind described.

The various features of novelty which characterize the invention are pointed out with particularity in the claims annexed to and forming a part of the disclosure. For a better understanding of the invention, its operating advantages, specific objects attained by its use, reference should be had to the drawings and descriptive matter in which there are illustrated and described preferred embodiments of the invention.

DETAILED DESCRIPTION OF THE INVENTION

Figure 1:
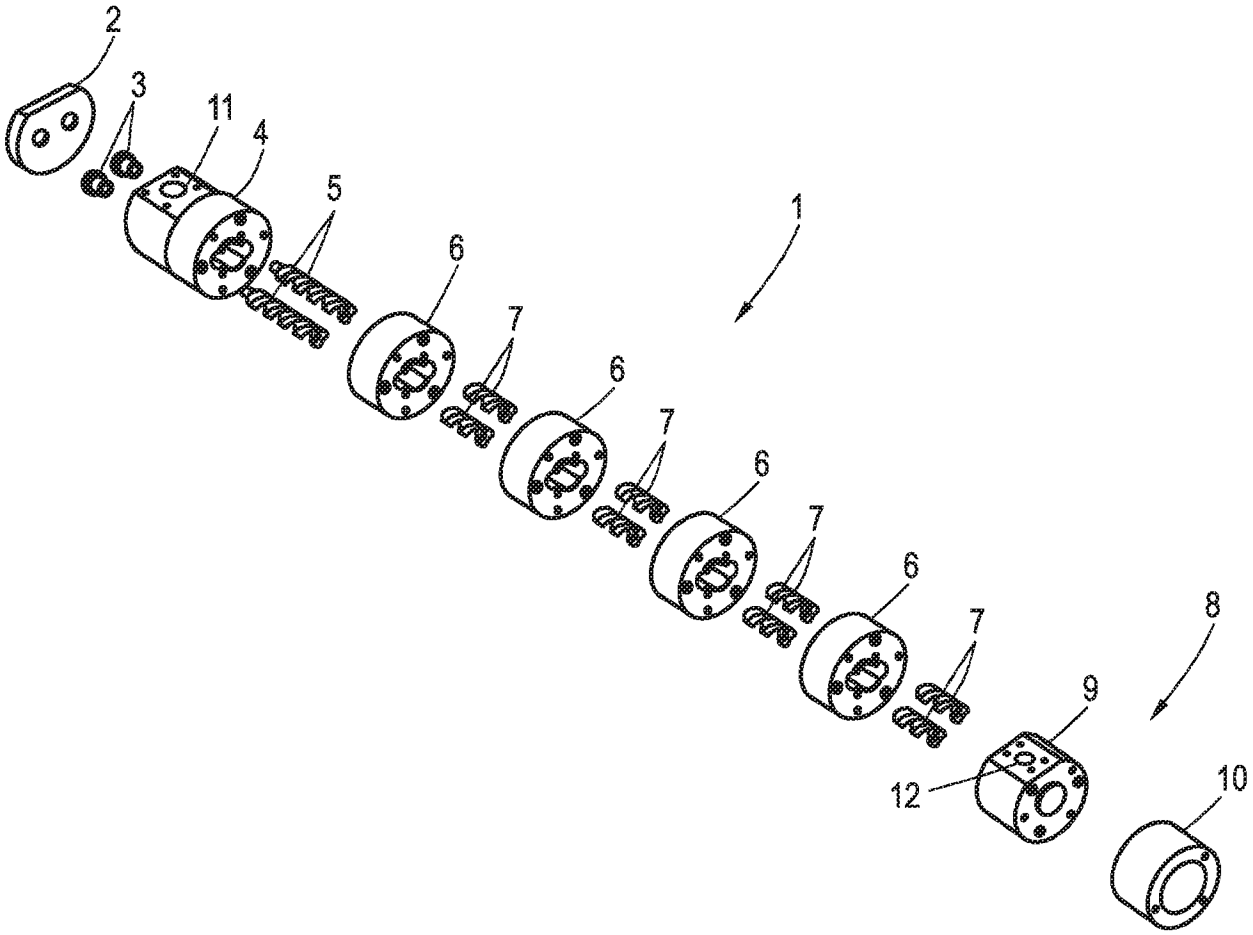
FIG. 1 shows a representation of the individual parts of the modular system according to the invention.

FIG. 1 shows a modular system 1 according to the invention, the central parts whereof are shown individually. The connection screws required in each case are not shown and also the respective size-specific drive spindles.

Starting from left to right, the modular system 1 comprises a housing cover 2, two alignment sleeves 3 (the screw spindle pumps that can be produced according to the invention have two running spindles in the example shown), a basic housing component 4, two running spindle base elements 5, four intermediate housing elements 6, eight running spindle extension elements 7, and also two housing pressure component elements 9, 10 forming a housing pressure component 8. The basic housing component 4, the intermediate housing elements 6 and also the housing pressure component elements 9, 10 have corresponding holes, on the one hand to receive the drive spindle which is not shown and to store and seal it in the case of the housing pressure component 8 and in order to receive the corresponding running spindles formed from the running spindle base elements 5 and the running spindle extension elements 7.

The basic housing component 4 has a fluid inlet 11 and forms a basic pump chamber. The housing pressure component 8 has a fluid outlet 12 on the housing pressure component element 9. Moreover, it forms a pressure chamber along with the housing pressure component element 9, which pressure chamber communicates with the fluid outlet 12.

Within the modular system 1 the intermediate housing components 6 and also the running spindle extension elements 7 are designed identically to one another. This, and the fact that with each pump size that can be produced with the help of the modular system 1, the housing cover 2, the housing base element 4 and also the housing pressure component or else the housing pressure component elements 9 and 10 always have to be installed, means that as a consequence any pump sizes can be produced from corresponding identical parts.

FIGS. 2-5 show different pumps that can be made from the modular system 1 according to FIG. 1, wherein the same reference numbers are used for the same components in each case.

Figure 2:
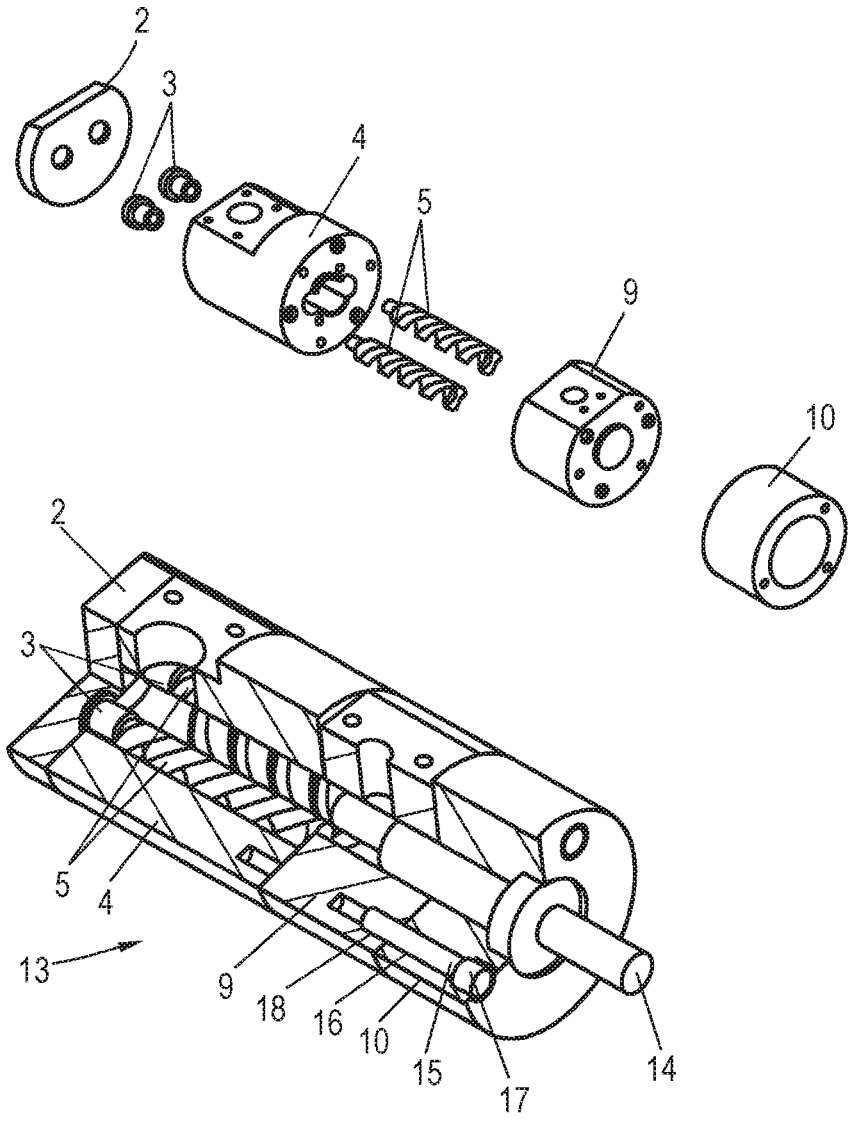
FIG. 2 shows a partial sectional view of a first pump produced from the modular system according to FIG. 1 and also the essential parts thereof shown in an exploded view.

FIG. 2 shows a pump 13 according to the invention in the shortest variant. Apart from a drive spindle 14, which can be individually produced size-specifically as a single component in each case, this is made up of the housing cover 2, the basic housing component 4, the two housing pressure component elements 9, 10, and also the two running spindle base elements 5 and the two alignment sleeves 3. The running spindle base elements 5 are received exclusively in the basic housing element 4. The division between the basic housing element 4 and the housing pressure element 8 or else the housing pressure element 9 is selected in such a manner that the running spindle base elements 5 end exactly at the dividing or separating plane.

Furthermore by way of example, a connection screw 15 is shown which is used to connect the housing pressure component element 10 to the housing pressure component element 9. For this purpose, the housing pressure component element 10 has a corresponding through-hole 16 with a screw head socket 17, while the housing pressure component element 9 has a corresponding threaded hole 18 into which the connection screw 15 is screwed. In the example shown, three screw connections of this kind are made in the example shown.

Figure 7:
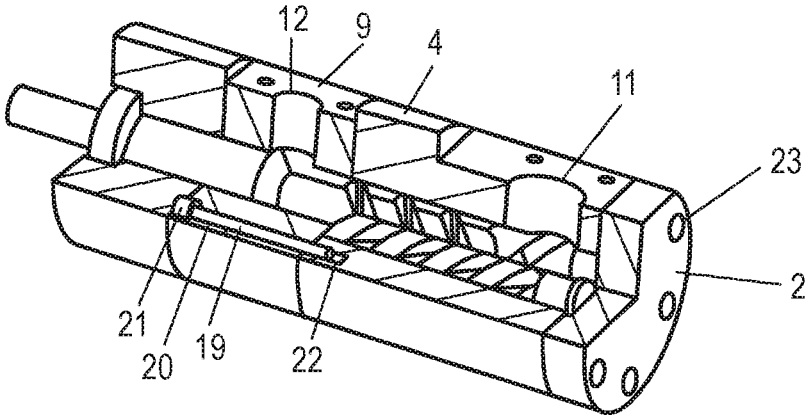
FIG. 7 shows a partial sectional view through the pump from FIG. 2 in a further sectional plane.

On account of the sectional plane chosen, the screw connection of the housing pressure component 9 to the basic housing component 4 is not shown. In this respect, reference is made here to FIG. 7, where another sectional plane is shown. A connection screw 19 is shown there which passes through a corresponding through-hole 20 with a screw head socket 21 which is formed in the housing pressure component element 9 and is screwed into a corresponding threaded hole 22 in the basic housing element 4. It goes without saying that here, too, a plurality of screw connections of this kind is provided distributed about the periphery.

In this view, the corresponding through-holes 23 which pass through the housing cover 2 are shown, into which corresponding connection screws not shown in further detail are inserted, which connection screws are screwed into corresponding threaded bores on the end face of the basic housing element 4, likewise not shown.

In the component representation likewise shown in FIG. 2, the system parts used here are depicted once again, apart from the corresponding connection screws.

Figure 3:
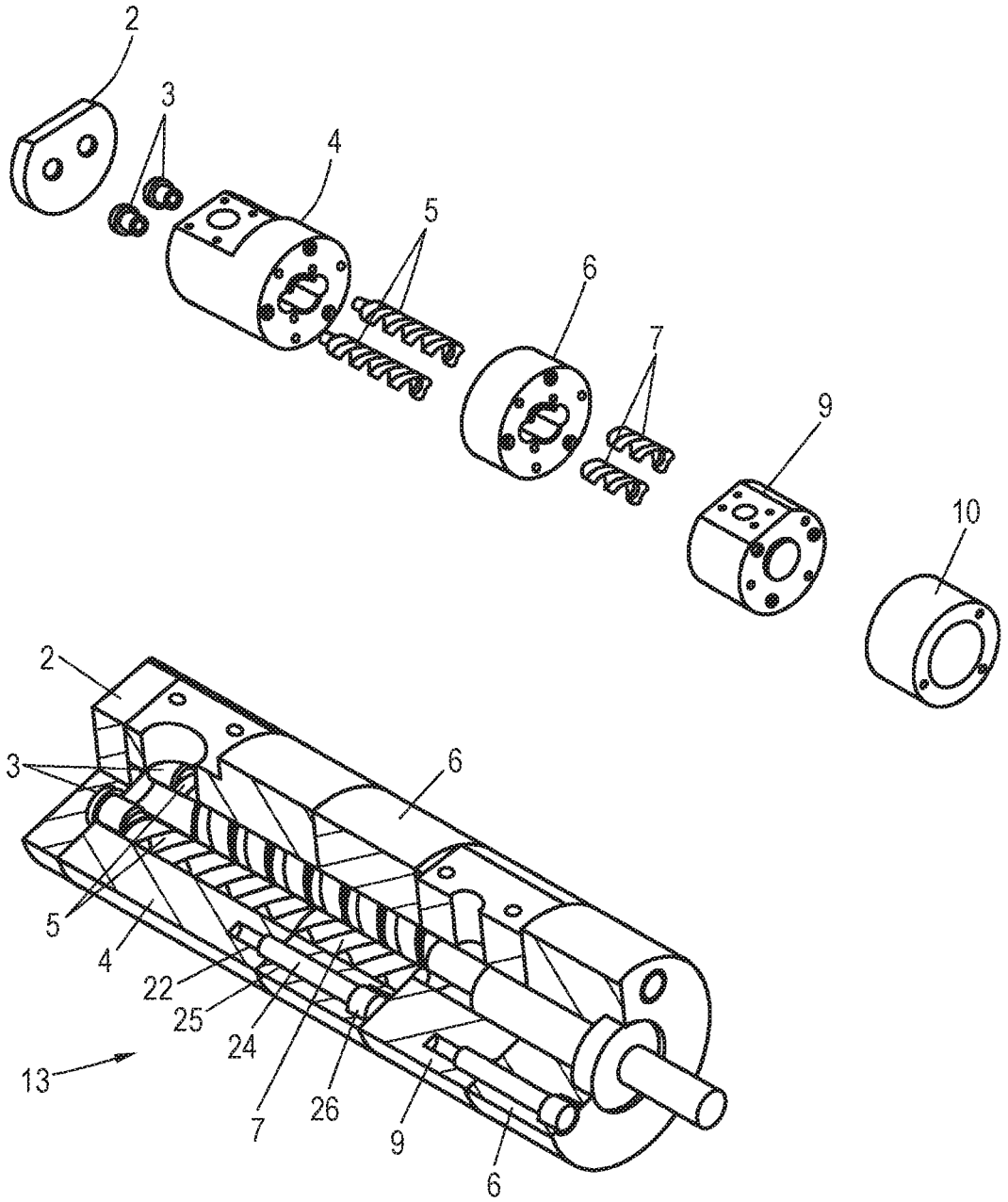
FIG. 3 shows a partial sectional view of a next-sized pump and also the necessary essential parts thereof.

FIG. 3 shows a second pump 13 that can be produced from the modular system 1 in a next pump size. This pump 13 is also made up in this case of the housing cover 2, the basic housing component 4, the two housing pressure component elements 9, 10, and also the two running spindle elements 5 and the alignment sleeves 3. In addition, in this case an intermediate housing component 6 is placed between the basic housing component 4 and the housing pressure component element 9, in which two running spindle extension elements 7 are also received, only one of which can be seen in this case. The separating planes, in other words the dividing planes between the basic housing component 4 and the intermediate housing element 6 and also between the intermediate housing element 6 and the housing pressure component element 9, and the separating plane between the running spindle base element 5 and the running spindle extension element 6, on the one hand, and the end of the running spindle extension element 7 coincide, in other words, the length of the intermediate housing component 6 corresponds exactly to the length of the running spindle extension element 7. The running spindle base element 5 and the running spindle extension element 7 lie with their axial, planar end faces only abutting one another; they are not connected to one another. They are, however, carried along via the engagement of the corresponding thread flanks with the thread flanks of the drive spindle 15 in a manner known per se.

Furthermore shown here is a connection screw 24 via which the intermediate housing component 6 is connected to the basic housing component 4. A plurality of through-holes 25 with corresponding screw head sockets 26 is formed on the intermediate housing component 6, see also FIG. 6 in this respect, while the threaded holes 22 are configured on the end face of the basic housing component 4, as already described. The corresponding connection screws 24 are screwed into said threaded holes.

Figure 6:
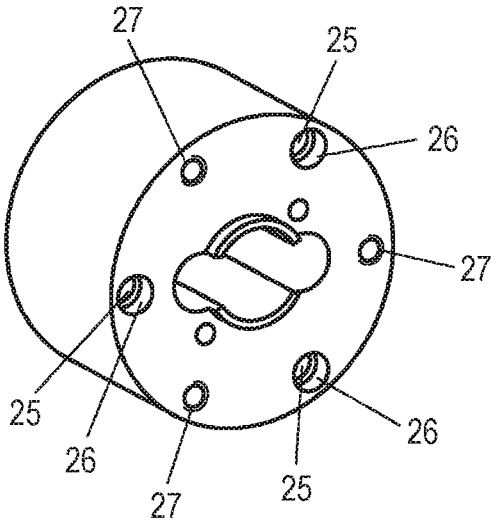
FIG. 6 shows a perspective view of an intermediate housing component.

As shown in FIG. 6, alongside the through-holes 25 on the corresponding end face, threaded holes 27 are also provided as blind holes (this applies to all threaded holes). These threaded holes 27 serve to receive connection screws 19, as have already been described in relation to FIG. 7, and as are also shown by way of example in FIG. 8, where the housing pressure component element 9 is connected via these connection screws 19 to an intermediate housing component 6. The connection screws 19 are screwed into the corresponding threaded holes 27 via which the component connection is made.

In the component representation likewise shown in FIG. 3, it can be seen that to this extent identical components to those in the case of the pump 13 from FIG. 2 are used, but in addition an intermediate housing component 6 and also the running spindle extension elements 7 arranged therein and exhibiting the identical length to the intermediate housing component 6.

Figure 4:
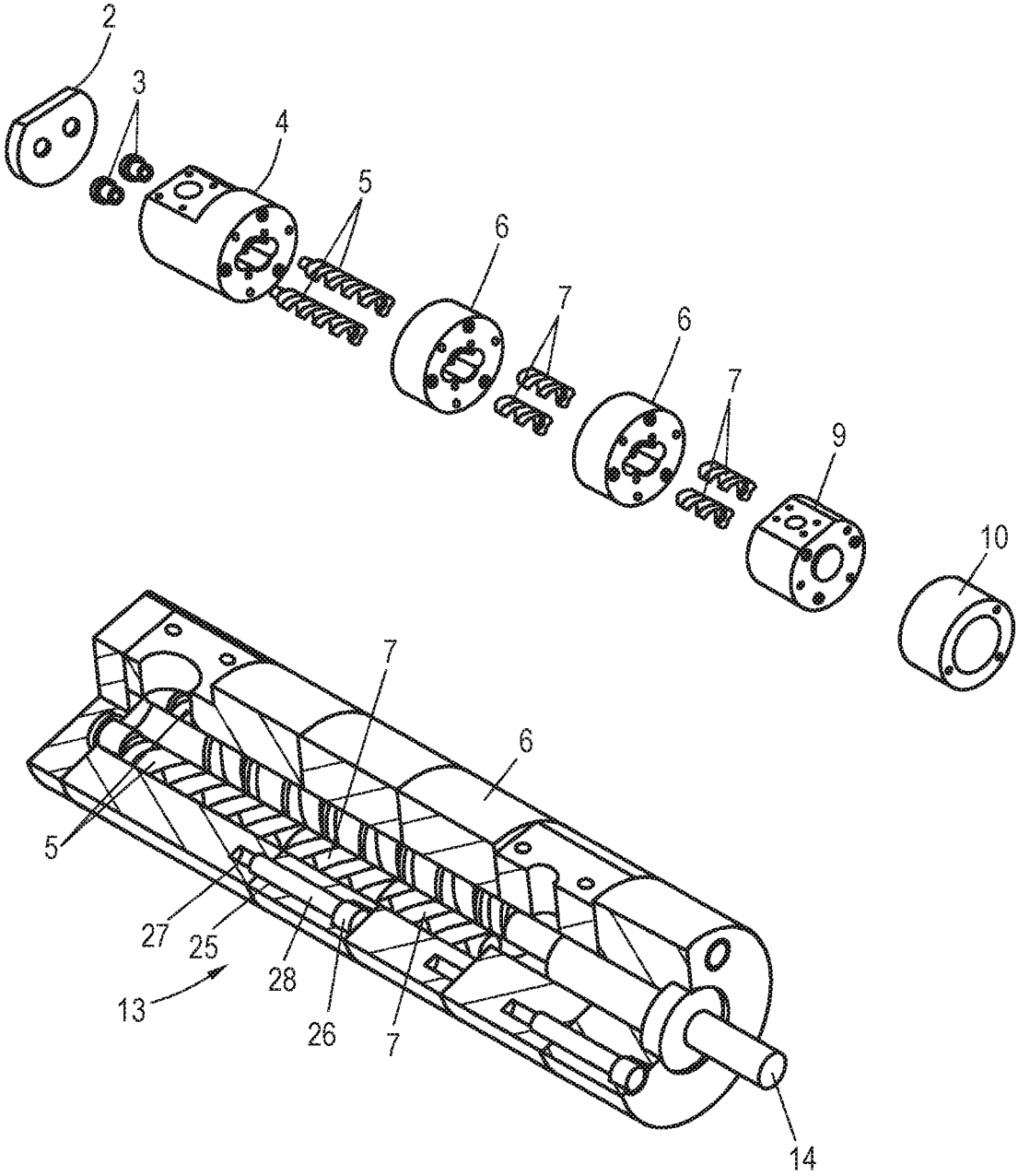
FIG. 4 shows a partial sectional view of the next-sized pump, in turn, alongside a representation of the essential parts.

The next larger expansion stage of the pump 13 that can be produced from the modular system according to the invention is shown in FIG. 4. Here, identical components to those in the case of the pump 13 from FIG. 3 are provided; in addition, in this case a further intermediate housing component 6 and also two other running spindle extension elements 7 are provided. In other words, the entire pump chamber has been lengthened once again with the additional pump chamber realized by means of an intermediate housing component 6 in conjunction with the running spindle extension elements 7.

In order to connect two intermediate housing elements 6, connection screws 28 are in turn used which pass through the one intermediate housing component 6 into the through-holes 25 and are received with their screw heads recessed in the screw head sockets 26. The connection screws 28 are screwed into the corresponding blind threaded holes 27 on the adjacent intermediate housing element 6. It should be noted that the two intermediate housing components 6 are turned relative to one another through 180°, so that the through-holes 25 of the one intermediate housing component 6 align with the threaded holes 27 of the other intermediate housing component 6. This is possible due to the separation of the through-holes 25 and the threaded holes 27 by 120° in each case.

It should also be noted here that in turn the separation of the housing components, in other words the separation of the basic housing component 4 and also the intermediate housing components 6 and the housing pressure component element 9 and the corresponding dividing planes of the running spindle elements, in other words the running spindle base element, and also the two running spindle extension elements 7 are identical, or else the corresponding dividing planes coincide.

Figure 5:
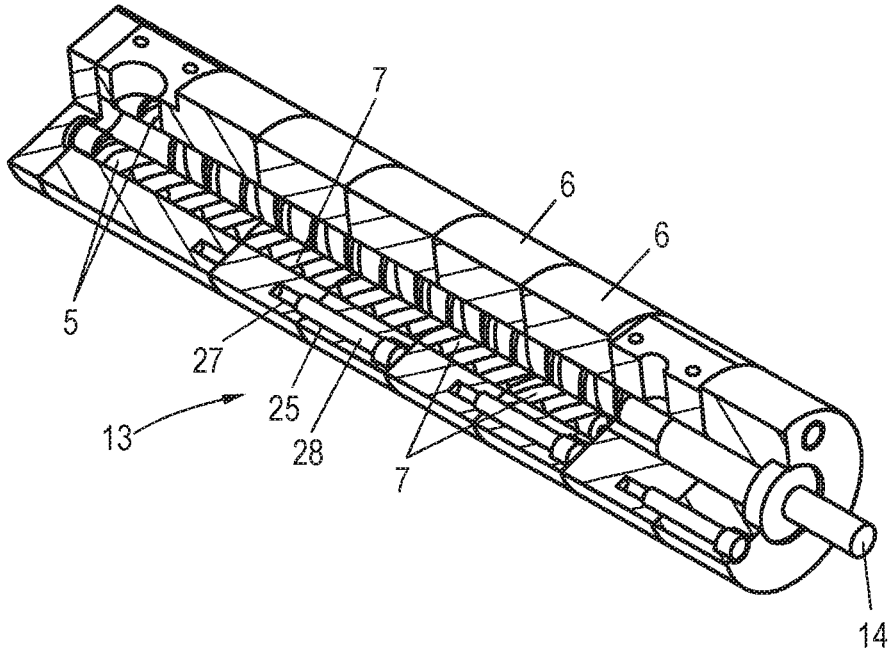
FIG. 5 shows a partial sectional view of the largest pump that can be produced from the modular system according to FIG. 1.

Finally, FIG. 5 shows a partial sectional view of a pump 13 according to the invention in the expansion stage that can be produced starting from the modular system according to FIG. 1. Likewise, the same components as in the pump according to FIG. 4 and also, in addition, two further intermediate housing components 6 and also four further running spindle additional elements 7 are provided. In this case, therefore, the pump chamber is extended by two further additional pump chambers formed via the additional intermediate housing elements 6, so that a maximum pump chamber comprising the base pump chamber and also four additional pump chambers results. This pump 13 is the most efficient, highest pressure-supplying pump, starting from the parts number shown in FIG. 1. Theoretically, the pump can of course be extended to any length, which means that pumps which are longer than those shown in FIG. 5 can also be produced using the system according to the invention.

Figure 8:
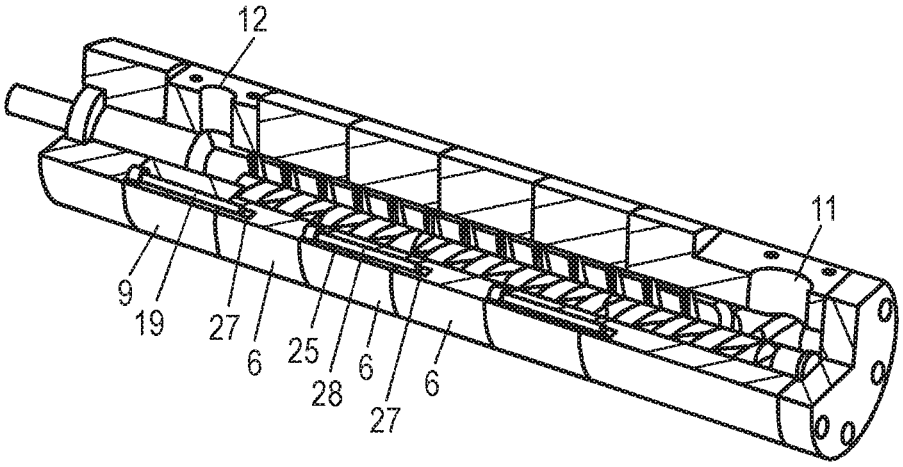
FIG. 8 shows a partial sectional view through the pump from FIG. 5 in a further sectional plane.

The intermediate housing components 6 are in turn connected to one another by connection screws 28; see in addition the view according to FIG. 8 which shows another sectional plane.

The individual representation is not shown here, as it is identical to the representation in FIG. 1.

As shown in FIGS. 2-5, only the drive spindle 14 in each case is the single component that has to be made individually for the respective pump size. The reason for this is that it is a one-piece spindle, while the running spindles in each case are all modular comprising the running spindle base elements 5 and the running spindle extension elements 7. As already mentioned, the running spindle base and extension elements 5, 7 are not connected to one another; instead, they only abut one another with their planar end faces, in order to facilitate a hydrodynamic plain bearing mounting exclusively within the respective housing portion and so that there are no friction problems in the region of the component transitions or dividing planes in each case.

While specific embodiments of the invention have been shown and described in detail to illustrate the inventive principles, it will be understood that the invention may be embodied otherwise without departing from such principles.

We claim:

1. A modular system for constructing a screw spindle pump, comprising:

a drive spindle;

at least one running spindle to mesh with the drive spindle to move fluid from a fluid inlet to a fluid outlet in an axial direction; and a housing including:

a basic housing component having the fluid inlet and a basic pump chamber, a housing pressure component having the fluid outlet and forming a pressure chamber, a housing cover arrangeable on the basic housing component, and a plurality of identical intermediate housing components, wherein any number of the intermediate housing components is selectively arrangeable between the basic housing component and the housing pressure component so as to form a corresponding number of additional pump chambers that together with the basic pump chamber form a common pump chamber, the at least one running spindle including:

at least one running spindle base element arrangeable in the basic housing component, and a plurality of identical running spindle extension elements, wherein any number of the running spindle extension elements is selectively arrangeable in the selected number of intermediate housing components so that the at least one running spindle base element and the number of running spindle extension elements form the running spindle, wherein the housing cover is configured to support the at least one running spindle, wherein when the drive spindle, the at least one running spindle and the housing are configured so that when the drive spindle, the at least one running spindle and the housing are assembled the drive spindle extends parallel to the at least one running spindle, through the housing pressure component and into the basic pump chamber so that the drive spindle and the at least one running spindle move the fluid from the fluid inlet to the fluid outlet.

2. The modular system according to claim 1, wherein the division of the basic housing component and the intermediate housing components and also the running spindle elements is identical.

3. The modular system according to claim 1, wherein the running spindle extension elements and the running spindle base elements only abut one another with their planar end faces.

4. The modular system according to claim 1, wherein at least the intermediate housing components have axial through-holes in an arrangement distributed about the periphery with a screw head recess on the end face and axial threaded holes, wherein the through-holes and the threaded holes are provided in an alternating arrangement to one another.

5. The modular system according to claim 1, wherein the housing pressure component comprises two housing pressure component elements connected or connectible to one another axially via screw connections.

6. The modular system according to claim 1, wherein only through-holes are formed on the housing pressure component, where necessary with screw head recesses on the end face, or that only through-holes are formed on the axially outer housing pressure component element, where necessary with screw head recesses on the end face, and axial through-holes with a screw head recess on the end face, and also axial threaded holes are formed on the axially internal housing pressure component element in an arrangement distributed about the periphery, wherein the through-holes and the threaded holes are provided in an alternating arrangement to one another.

7. The modular system according to claim 1, wherein the basic housing component has threaded holes on both axial end faces.

8. The modular system according to claim 1, wherein the length of the running spindle base elements is greater than the length of the running spindle extension elements.

9. The modular system according to claim 1, wherein the end or ends of the running spindle base elements arranged adjacent to the housing cover are received in the alignment sleeves used to align an axial thrust.

10. A pump produced using a modular system according to claim 1.

* * * * *